US007096786B2

(12) United States Patent
Takeuchi

(10) Patent No.: US 7,096,786 B2
(45) Date of Patent: Aug. 29, 2006

(54) INK FOUNTAIN APPARATUS FOR ROTARY PRINTING PRESS

(75) Inventor: Tetsuya Takeuchi, Ibaraki (JP)

(73) Assignee: Komori Corporation, Tokyo (JP)

( * ) Notice: Subject to any disclaimer, the term of this patent is extended or adjusted under 35 U.S.C. 154(b) by 49 days.

(21) Appl. No.: 10/993,284

(22) Filed: Nov. 18, 2004

(65) Prior Publication Data

US 2005/0103216 A1 May 19, 2005

(30) Foreign Application Priority Data

Nov. 19, 2003 (JP) ..... 2003-388956

(51) Int. Cl.
*B41F 31/00* (2006.01)

(52) U.S. Cl. ..... 101/350.1; 101/364

(58) Field of Classification Search ..... 101/207, 101/208, 210, 350.1, 363, 364, 350.7
See application file for complete search history.

(56) References Cited

U.S. PATENT DOCUMENTS 4,584,941 A 4/1986 Weber
4,991,504 A 2/1991 Fina
6,598,525 B1 * 7/2003 Metrope ..... 101/363
6,772,684 B1 * 8/2004 Kanayama ..... 101/350.1
2003/0164104 A1 9/2003 Kanayama

FOREIGN PATENT DOCUMENTS

EP 1167032 1/2002

* cited by examiner

*Primary Examiner*—Ren Yan
(74) *Attorney, Agent, or Firm*—Blakely Sokoloff Taylor & Zafman

(57) ABSTRACT

An ink fountain apparatus for a rotary printing press includes an ink fountain, an intermediate ink dam, and press unit for simultaneously pressing the intermediate ink dam toward the outer surface of the fountain roller and toward the upper surface of the bottom plate. A width of the first surface close to the boundary portion in the axial direction of the fountain roller is set to be smaller than a width of the first surface arranged upstream of the fountain roller in a rotational direction from the boundary portion in the axial direction of the fountain roller.

8 Claims, 5 Drawing Sheets

INK FOUNTAIN APPARATUS FOR ROTARY PRINTING PRESS

BACKGROUND OF THE INVENTION

The present invention relates to an ink fountain apparatus for a rotary printing press, which stores ink to be supplied to a plate surface and, more particularly, to an ink fountain apparatus for a rotary printing press, which has intermediate ink dams arranged between a pair of opposing ink dams.

When printing is to be performed with a rotary printing press, the plate sometimes has a pattern at only its portion in the entire width depending on the specifications of the printing products. In this case, if ink is stored in the entire ink fountain and printing is performed, the ink may be wasted. For this reason, intermediate ink dams are formed on two sides of a portion corresponding to the pattern, and the ink is stored in only inside the intermediate ink dams. In rainbow printing wherein inks of different colors are supplied to appropriate portions in the entire length of the plate cylinder and several colors are printed at once, intermediate ink dams are provided so that adjacent inks do not mix with each other.

As disclosed in U.S. patent application No. 2003/0164104, a conventional intermediate ink dam includes a press plate made of an elastic material which has a fountain press portion for pressing the outer surface of a fountain roller, and a blade press portion for pressing a fountain blade. A press means presses this press plate toward the fountain roller and the fountain blade, simultaneously.

In the above conventional ink fountain apparatus for the rotary printing press, when the plurality of intermediate ink dams are arranged, the press forces of the press means must be large in order to suppress variations between the press forces of the press plates of the respective intermediate ink dams. For this reason, since the fountain roller is flexed by an overload applied from the press plates to the outer surface of the fountain roller, an ink film with an appropriate film thickness cannot be formed on the outer surface of the fountain roller, thus posing a problem. Also, the overload is applied to the fountain roller because a contact resistance between the press plates and the fountain roller is made large by the overload, and a rotational driving system of the fountain roller is braked, thus posing a problem.

Also, in the conventional ink fountain apparatus for the rotary printing press, if the width of the fountain press portion of the press plate is made small, inks mix with each other when attaching the intermediate ink dam for the fountain roller not perpendicularly but slantly. Therefore, the width of the fountain press portion must be large to some degree. Alternatively, if the width of the fountain press portion is made large, a press surface with the large width stops supplying the ink downstream of the fountain roller. For this reason, the press force of the press means must be made large, thus posing the same problem as described above.

SUMMARY OF THE INVENTION

It is an object of the present invention to provide an ink fountain apparatus for a rotary printing press which can form an ink film with an appropriate film thickness on the outer surface of a fountain roller.

It is another object of the present invention to provide an ink fountain apparatus for a rotary printing press which prevents an overload applied to a rotational driving system for driving the fountain roller.

In order to achieve the above objects of the present invention, there is provided an ink fountain apparatus for a rotary printing press, which includes an ink fountain comprised of a rotatably supported ink fountain roller, a bottom plate which has a distal end close to an outer surface of the ink fountain roller and extends in an axial direction of the fountain roller, and a pair of ink dams substantially standing upright from the bottom plate and arranged to oppose in the axial direction of the ink fountain roller through a predetermined distance, an intermediate ink dam substantially standing upright from the bottom plate between the pair of ink dams, the intermediate ink dam having a first surface in contact opposite to the outer surface of the fountain roller, a second surface in contact opposite to an upper surface of the bottom plate, and a boundary portion allowing the first surface and the second surface to communicate with each other, and press means for simultaneously pressing the intermediate ink dam toward the outer surface of the fountain roller, and the upper surface of the bottom plate, wherein a width of the first surface close to the boundary portion in the axial direction of the fountain roller is set to be smaller than a width of the first surface on an upstream side of the fountain roller in a rotational direction from the boundary portion in the axial direction of the fountain roller.

DESCRIPTION OF THE PREFERRED EMBODIMENT

The present invention will be described in detail with reference to FIGS. 1 to 6.

Figure 2:
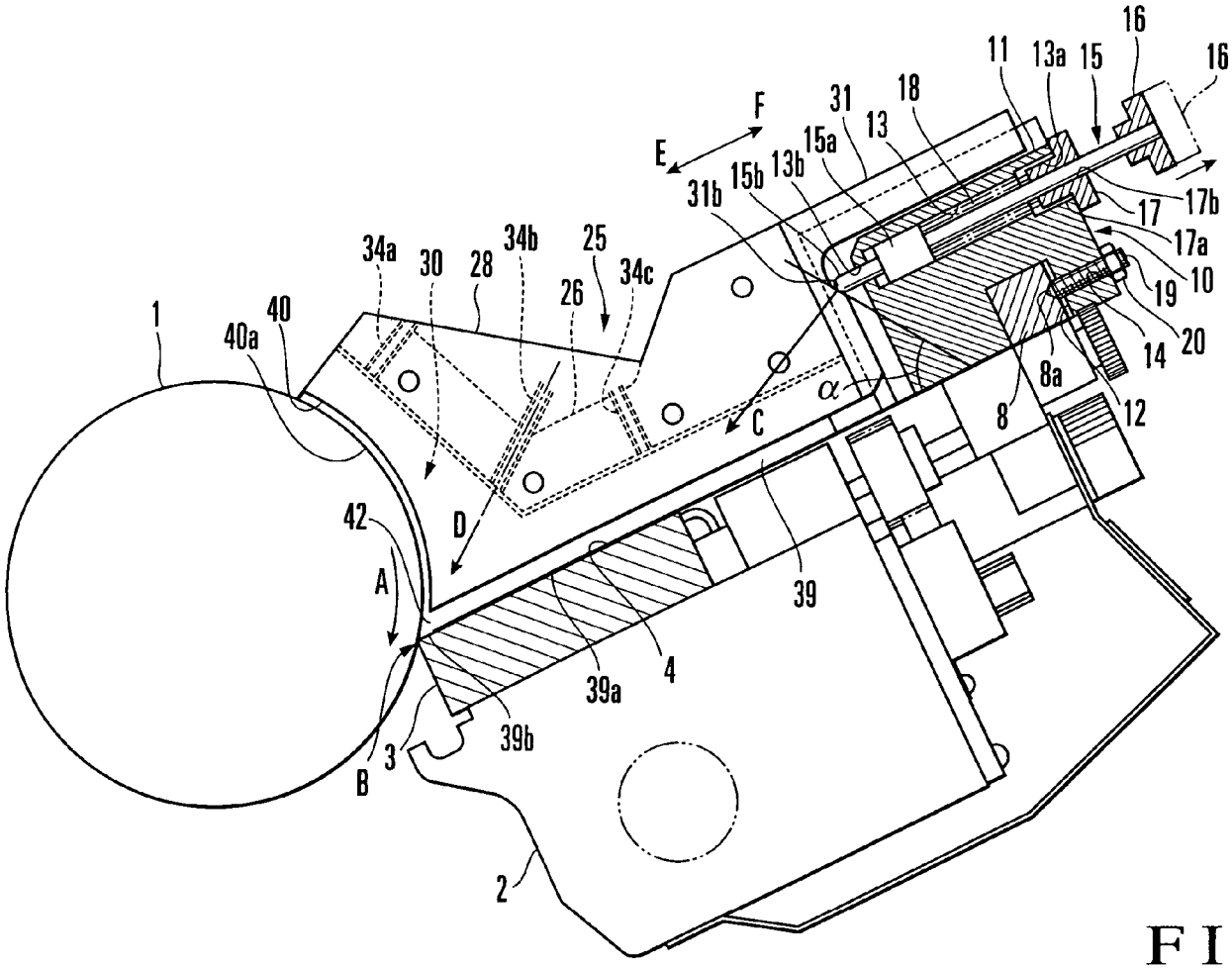
FIG. 2 is a sectional view taken along the line II—II of FIG. 1.

FIG. 2 shows an ink fountain apparatus for a rotary printing press according to an embodiment of the present invention. Referring to FIG. 2, an ink fountain roller 1 rotatable in the direction of an arrow A axially extends between a pair of frames (not shown) arranged to oppose each other through a predetermined distance, and a blade base 2 is provided beside the ink fountain roller 1 such that its two ends are supported by the pair of frames. A large number of ink fountain keys 3 divided in the axial direction of the ink fountain roller 1 are placed on a slant surface at the upper end of the blade base 2. When a motor (not shown) is driven, the aperture ratios of the distal ends of the ink fountain keys 3 are adjusted in directions to become close to and away from the outer surface of the ink fountain roller 1.

One ink fountain blade 4 formed of a thin steel plate to serve as a bottom plate is magnetically attracted so it comes into tight contact with the ink fountain key 3 to cover the large number of ink fountain keys 3. In this case, the distal end of the fountain key 3 opposing the outer surface of the ink fountain roller 1 is exposed from the fountain blade 4.

Figure 1:
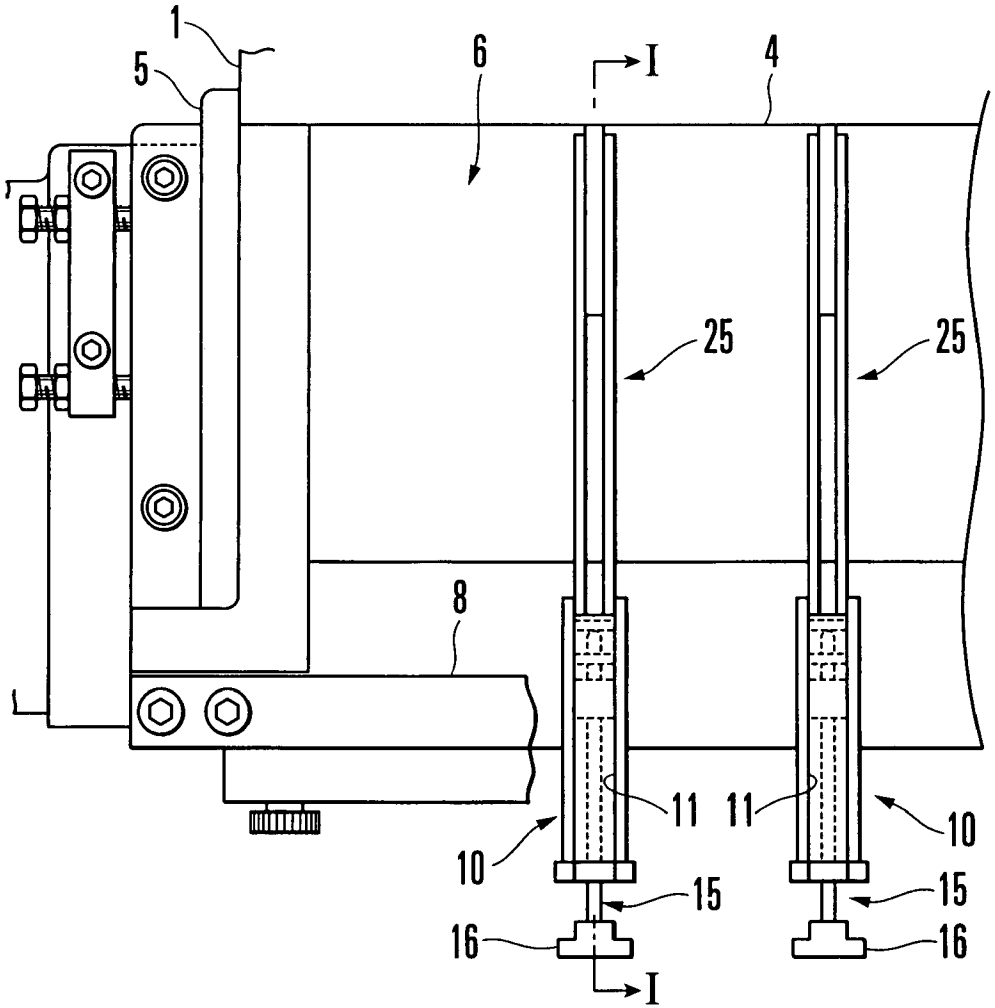
FIG. 1 is a plan view of the main part of an ink fountain apparatus for a rotary printing press according to an embodiment of the present invention.

Referring to FIG. 1, a pair of opposing ink dams 5 arranged to correspond to the two ends of the ink fountain roller 1 are fixed to a member (not shown) swingably supported between the frames, such that the inner surfaces of their distal ends are pressed by the two end faces of the ink fountain roller 1. The pair of ink dams 5 standing upright from the ink fountain blade 4, the outer surface of the ink fountain roller 1, and the ink fountain blade 4 make up a tub-like ink fountain 6. A bar 8 extending in the axial direction of the ink fountain roller 1 behind the ink fountain 6 has two ends fixed to the member (not shown) swingably supported between the frames.

Figure 4:
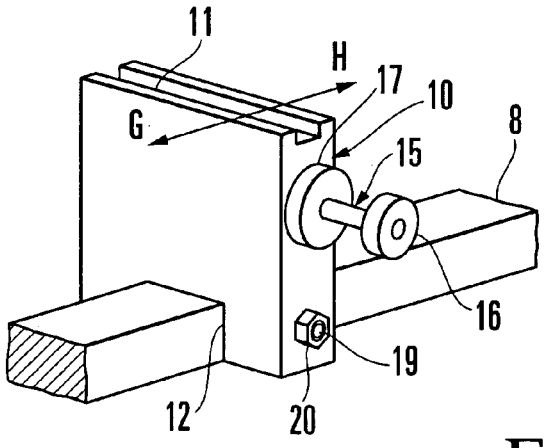
FIG. 4 is a perspective view of the holder shown in FIG. 1.

As shown in FIG. 4, a thin-plate-like rectangular parallelepiped holder 10 has a fitting groove 11 with a U-shaped section to communicate with its upper end and its side surface on the ink fountain roller 1 side, and a notch 12, extending in the axial direction of the ink fountain roller 1, in its lower end. The notch 12 is slightly larger than the sectional area of the bar 8. As shown in FIG. 2, a blind hole-like spring accommodating hole 13 is formed in the upper portion of the holder 10. A threaded portion 13*a* is formed at the inlet port of the spring accommodating hole 13, and a small-diameter insertion hole 13*b* is formed in the spring accommodating hole 13 to reach its bottom. A screw hole 14 with a screw portion extending to reach a recess 8*a* of the bar 8 is formed in the lower portion of the holder 10.

Referring to FIG. 2, an operation rod 15 serving as a thin, elongated press member has a spring accepting portion 15*a*, with a diameter slightly smaller than the diameter of the spring accommodating hole 13, at its distal end. A press shaft portion 15*b* with a diameter slightly smaller than the diameter of the insertion hole 13*b* projects from one end of the spring accepting portion 15*a* toward the ink fountain roller 1. A handle member 16 is fixed to the proximal end (counter distal end) of the operation rod 15. A screw 17 has a screw portion 17*a* threadably engageable with the threaded portion 13*a* of the spring accommodating hole 13, and an insertion hole 17*b* with a diameter slightly larger than the diameter of the operation rod 15 is formed at the center of the screw 17.

A compression coil spring 18 serving as a biasing means is elastically mounted between the spring accepting portion 15*a* of the operation rod 15 inserted in the spring accommodating hole 13 and the screw 17 with the screw portion 17*a* threadably engaging with the threaded portion 13*a*. The press shaft portion 15*b* of the operation rod 15 in the insertion hole 13*b* is then biased from the holder 10 in a direction to become close to the ink fountain roller 1. A set screw 19 threadably engages with the screw hole 14 of the holder 10 and serves to fix the holder 10 to the bar 8. A nut 20 threadably engages with the set screw 19 and serves to regulate forward/backward movement of the set screw 19.

Figure 3:
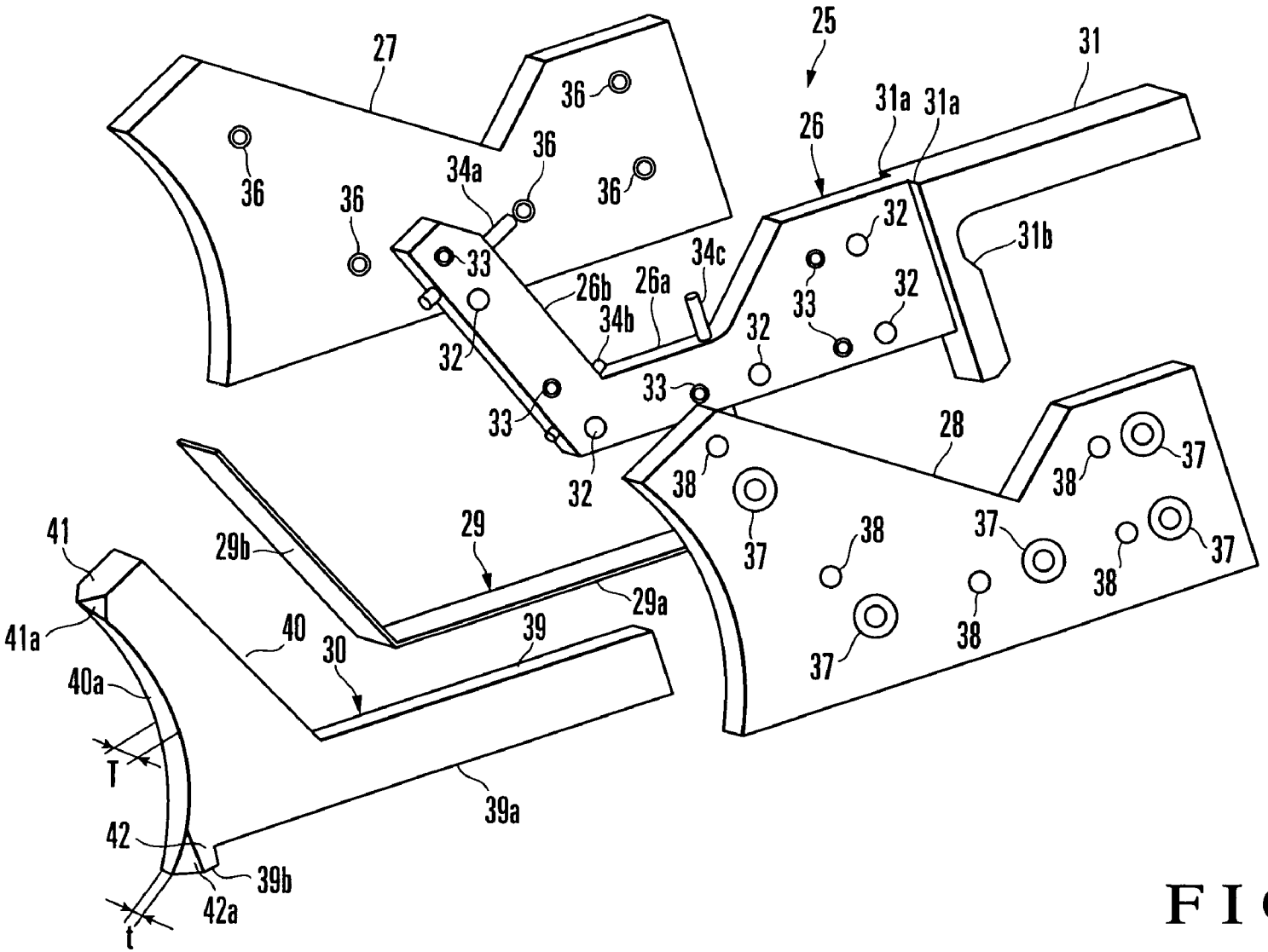
FIG. 3 is an exploded perspective view of the ink fountain apparatus shown in FIG. 1.

Referring to FIG. 1, a pair of opposing intermediate ink dams 25 are arranged between the ink dams 5. As shown in FIG. 3, each intermediate ink dam 25 is comprised of an operation plate (third member) 26, a pair of sandwiching plates 27 and 28 for sandwiching the operation plate 26 from two sides, an adjustment plate (second member) 29 in contact opposite to the lower surface of the operation plate 26, and a press plate (first member) 30 having an upper end face in contact opposite to the lower surface of the adjustment plate 29. The press plate 30 is arranged in the same planar direction as those of the operation plate 26 and sandwiching plates 27 and 28.

The operation plate 26 is formed of a horizontal portion 26*a* extending in a direction perpendicular to the axial direction of the ink fountain roller 1 and an upright portion 26*b* extending obliquely upward from the distal end of the horizontal portion 26*a*, to have a substantial L shape. A substantially L-shaped support 31 is integrally formed at the front end of the horizontal portion 26*a* to be thicker than the horizontal portion 26*a* because of steps 31*a*. The horizontal portion of the support 31 is fitted in the fitting groove 11 of the holder 10, and part of the vertical portion of the support 31 forms an engaging surface 31*b* formed of a slant surface. As shown in FIG. 2, the slanting direction of the engaging surface 31*b* is set such that an angle a formed by the upper surface of the ink fountain blade 4 and the extension of the slant surface of the engaging surface 31*b* is an acute angle.

As shown in FIG. 3, the operation plate 26 has, in its the horizontal portion 26*a* and upright portion 26*b*, a total of five insertion holes 32 and a total of five screw holes 33. Three adjustment bolts 34*a*, 34*b*, and 34*c* threadably engage with screw holes formed at the upper and lower portions of the upright portion 26*b* and the substantial center of the horizontal portion 26*a* of the operation plate 26. The adjustment bolt 34*b* attached to the lower portion of the upright portion 26*b* moves forward/backward (in the direction indicated by an arrow D) toward a point B where the outer surface of the ink fountain roller 1 and the ink fountain key 3 oppose each other. The sandwiching plate 27 has five screw holes 36 corresponding to the insertion holes 32 of the operation plate 26. The sandwiching plate 28 has five insertion holes 37 with spot-faced upper surfaces to correspond to the insertion holes 32 of the operation plate 26, and five insertion holes 38 corresponding to the screw holes 33.

The adjustment plate 29 is formed by bending a thin steel plate with spring properties into a substantial L shape. The adjustment plate 29 is comprised of a horizontal portion 29*a* in contact opposite to the lower surface of the horizontal portion 26*a* of the operation plate 26, and an upright portion 29*b* in contact opposite to the rear end face of the upright portion 26*b*. The press plate 30 standing upright in contact with the lower surface of the adjustment plate 29 is made of polyvinyl chloride as an elastic material with an overall wear resistance into a substantial L shape. The press plate 30 is comprised of a horizontal portion 39 with an upper end face in contact opposite to the horizontal portion 29*a* of the adjustment plate 29, and an upright portion 40 with a front end face in contact opposite to the upright portion 29*b* of the adjustment plate 29.

The lower end face of the horizontal portion 39 of the press plate 30 serves as a linear blade press portion 39*a* for pressing the blade 4, and the rear end face of the upright portion 40 serves as an arcuate ink fountain press portion 40*a* for pressing the outer surface of the ink fountain roller 1. The width of the adjustment plate 29 and the plate thickness of the press plate 30 are almost the same, and are slightly smaller than the thicknesses of the horizontal portion 26*a* and upright portion 26*b* of the operation plate 26.

Figure 5B:
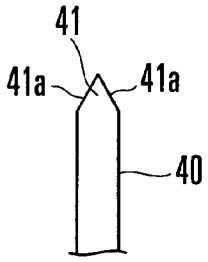
FIG. 5B is a view taken along the line II in FIG. 5A.
Figure 5A:
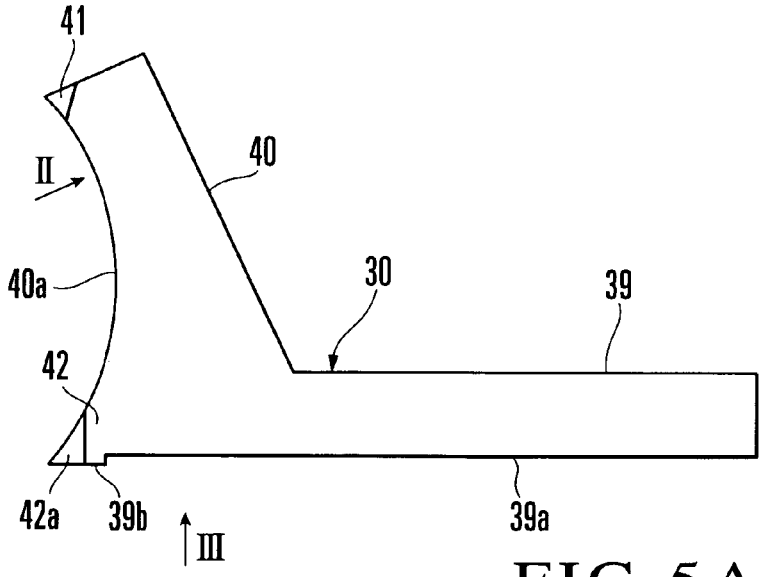
FIG. 5A is a side view of the press plate shown in FIG. 3.
Figure 5C:
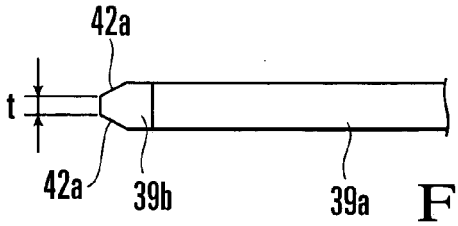
FIG. 5C is a view taken along the line III in FIG. 5A.

As shown in FIG. 5B, at the upper end portion of the fountain press portion 40*a*, i.e., on the upstream side in the rotational direction of the fountain roller 1, an ink distribution portion 41 is formed, which has a pair of slant surfaces 41*a* slanting from the two side surfaces of the press plate 30 toward the upper end of the fountain press portion 40*a*. The planar shape of the upper end portion of the ink distribution portion 41 in the fountain press portion 40*a* is almost triangular, and the width of its distal end is set to be smaller than a width t (to be described below) of the fountain press portion 40*a* close to a boundary portion 42. At the boundary portion 42 between the fountain press portion 40*a* and the blade press portion 39*a*, a projection 39*b* is formed, which projects from the blade press portion 39*a* downstream in the rotational direction along the outer surface of the fountain roller 1. The projection 39*b* presses the upper surface of the distal end of the ink fountain key 3 which is exposed from the fountain blade 4. The boundary portion 42 allows the fountain press portion 40*a* to communicate with the blade press portion 39*a*. In the plan view, as shown in FIG. 5C, the part of the fountain press portion 40*a* close to the boundary portion 42 is gradually tapered toward the distal end (toward the fountain roller 1). That is, the part of the fountain press portion 40*a* close to the boundary portion 42 has a pair of slant surfaces 42*a* which slant such that the part is gradually tapered from the two side surfaces toward the boundary portion 42.

As shown in FIG. 3, the width t at the distal end of the boundary portion 42 is set to be smaller than the width T in the axial direction of the fountain roller 1, which is set more upstream of the fountain press portion 40*a* in the rotational direction (in the direction of the arrow A) of the fountain roller 1 than the boundary portion 42. Also, the width of the adjustment plate 29 and the thickness of the press plate 30 in the axial direction of the fountain roller 1 are set to be substantially same. These widths are slightly smaller than the thicknesses of the horizontal portion 26*a* and upright portion 26*b* of the operation plate 26.

How to build the intermediate ink dam 25 in the ink fountain 6 will be described.

As shown in FIG. 3, flat head screws (not shown) inserted from the insertion holes 37 of the sandwiching plate 28 extend through the insertion holes 32 of the operation plate 26, to threadably engage with the screw holes 36 of the sandwiching plate 27. This fixes the sandwiching plate 28 to the sandwiching plate 27 to sandwich the operation plate 26. Then, set screws (not shown) are inserted from the insertion holes 38 of the sandwiching plate 28 to threadably engage with the screw holes 33 of the operation plate 26. This fixes the operation plate 26 to the sandwiching plate 28, so the operation plate 26 is sandwiched between the sandwiching plates 27 and 28.

When the operation plate 26 is sandwiched by the sandwiching plates 27 and 28, a space between the sandwiching plates 27 and 28 is formed under the operation plate 26. The adjustment plate 29 and press plate 30 are sequentially engaged in this space, so the adjustment plate 29 is in contact opposite to the lower surface of the operation plate 26 and the press plate 30 is in contact opposite to the lower surface of the adjustment plate 29. When the support 31 of the intermediate ink dam 25 built in this manner is fitted in the fitting groove 11 of the holder 10, as shown in FIG. 2, the intermediate ink dam 25 is supported in the fitting groove 11 to be slidable in a direction indicated by arrows E-F perpendicular to the axial direction of the ink fountain roller 1.

At this time, the blade press portion 39*a* and ink fountain press portion 40*a* of the press plate 30 project from the lower and rear ends, respectively, of each of the sandwiching plates 27 and 28. The elastic force of the compression coil spring 18 biases the operation rod 15 in a direction indicated by the arrow E to become close to the ink fountain roller 1, and the distal end of the press shaft portion 15*b* projecting from the insertion hole 13*b* abuts against the engaging surface 31*b* of the support 31. Since the engaging surface 31*b* is formed in such a direction that the angle a formed by the ink fountain blade 4 and the extension of the slant surface 31*b* is an acute angle, the press direction with respect to the press plate 30 changes as indicated by an arrow C. More specifically, the press plate 30 is pressed almost toward the point B where the outer surface of the ink fountain roller 1 and the ink fountain key 3 oppose each other. Therefore, the blade press portion 39*a* and ink fountain press portion 40*a* of the press plate 30 respectively press the ink fountain blade 4 and the outer surface of the ink fountain roller 1, and accordingly the blade press portion 39*a* and ink fountain press portion 40*a* come into tight contact with the ink fountain blade 4 and the outer surface of the ink fountain roller 1, respectively.

In this embodiment, since the operation plate 26 presses the press plate 30 through the thin plate-like adjustment plate 29, the press plate 30 is pressed uniformly and will not be locally fractured. Since the adjustment plate 29 is made of an elastic material, local elastic deformation of the press plate 30 can be prevented, so the tight contact force becomes uniform throughout the press plate 30.

How to adjust the tight contact state of the press plate 30 with respect to the ink fountain blade 4 and the outer surface of the ink fountain roller 1 will be described.

When the tight contact state of the whole press plate 30 is to be adjusted, the screw 17 is pivoted to change the forward/backward moving amount of the screw 17 with respect to the spring accommodating hole 13, thereby changing the elastic force of the compression coil spring 18. Thus, the press force of the compression coil spring 18 to press the press shaft portion 15*b* toward the engaging surface 31*b* changes, so the whole tight contact can be adjusted. This adjusting operation can be performed by only pivoting the screw 17. Therefore, tight contact adjustment can be performed easily.

If tight contact between the blade press portion 39*a* and ink fountain blade 4 and that between the ink fountain press portion 40*a* and the outer surface of the ink fountain roller 1 are partly insufficient, the threadable engagement amounts of the adjustment bolts 34*a*, 34*b*, and 34*c* are adjusted separately, to adjust the tight contact partly. In this case, when the threadable engagement amount of the adjustment bolt 34*b*, which moves forward/backward with respect to the point B where the outer surface of the ink fountain roller 1 and the ink fountain keys 3 oppose each other, is adjusted, the tight contact between the blade press portion 39*a* and ink fountain blade 4 and that between the ink fountain press portion 40*a* and the outer surface of the ink fountain roller 1 can be adjusted simultaneously.

According to this embodiment, the tight contact state of the press plate 30 can be partly adjusted, so partial outflow of the ink can be prevented. As a result, the amount of ink consumed can be reduced, and the printing quality of rainbow printing can be improved. As the press plate 30 is made of the elastic material, when the press state is to be partly adjusted, partial deformation of the press plate 30 due to the adjustment bolts 34*a* to 34*c* can be prevented.

As shown in FIG. 3, a projection 39*b* for pressing the upper surface of the distal end of the corresponding ink fountain key 3 exposed from the fountain blade 4 is formed at the distal end of the blade press portion 39*a* of the press plate 30. Since the projection 39*b* locally presses the upper surface of the distal end of the ink fountain key 3, and the blade press portion 39*a* except for the projection 39*b* presses the upper surface of the fountain blade 4, the tight contact of the press plate 30 to the fountain key 3 and the fountain blade 4 is further improved. Therefore, the ink from the ink fountain roller 1 does not enter a portion between the blade press portion 39*a* and ink fountain blade 4, through the blade press portion 39*a* and the ink fountain key 3. As a result, ink to be used for subsequent printing is prevented from mixing with printing ink used previously. Also, the ink fountain key 3 is prevented from causing an operation error because the entering ink solidifies.

Since the press plate 30 is made of the wear-resistant elastic material, wear of the press plate 30 at its portion in contact opposite to the ink fountain roller 1 and that in contact opposite to the ink fountain blade 4 are reduced. Also, the tight contact of the press plate 30 at its portion in contact opposite to the ink fountain roller 1 and that in contact opposite to the ink fountain blade 4 are improved.

To remove the intermediate ink dam 25, as shown in FIG. 2, the operator holds the holding member 16, and moves the operation rod 15 against the elastic force of the compression coil spring 18 in a direction to separate it away from the ink fountain roller 1. Then, the operator releases the engaging surface 31*b* which has been pressed by the press shaft portion 15*b*, and removes the operation rod 15 from the holder 10. In this manner, the intermediate ink dam 25 can be mounted and detached by merely moving the operation rod 15 against the elastic force of the compression coil spring 18 without requiring a tool. Thus, the intermediate ink dams 25 can be mounted and detached easily.

When the intermediate ink dam 25 is to be positionally adjusted in the axial direction of the ink fountain roller 1, in FIG. 2, the operator loosens the fastened nut 20 and rotates the set screw 19 to move it backward. Then, as shown in FIG. 4, the operator releases the holder 10 which has been fixed to the bar 8, and moves the holder 10 in the axial direction of the ink fountain roller 1 indicated by arrows G-H. In this manner, position adjustment of the intermediate ink dam 25 can be performed by merely loosening the fastened nut 20 and thereafter rotating the set screw 19. As a result, operation becomes easy.

Figure 6:
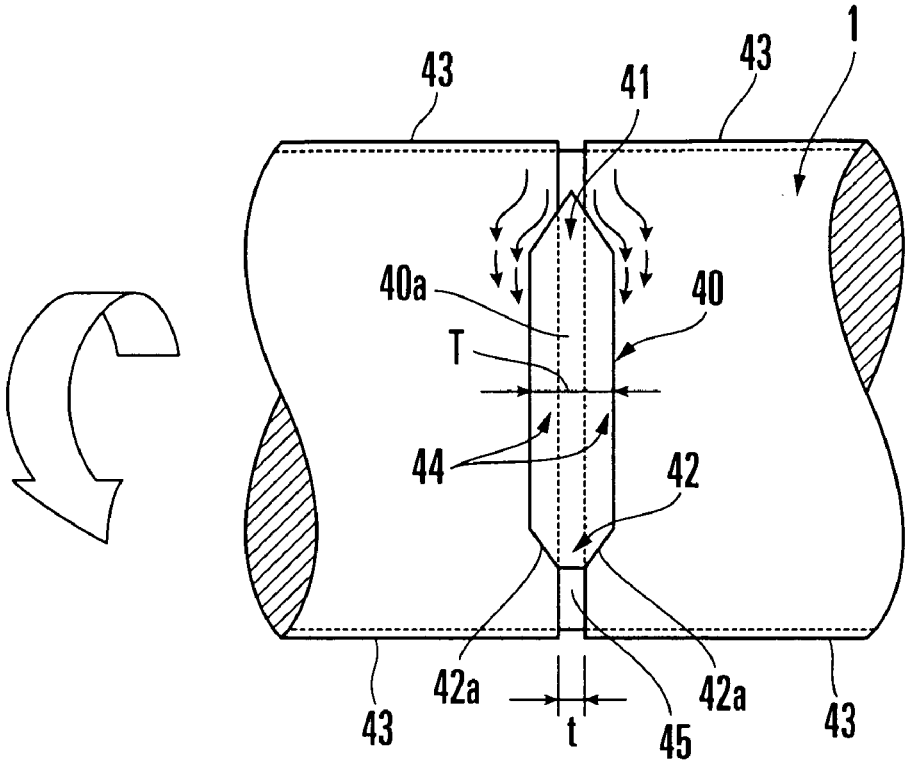
FIG. 6 is a front view of the fountain roller for explaining the flow of the ink.

Next, the flow of the ink on the outer surface of the ink fountain roller 1 will be described with reference to FIG. 6. Standing ink is prevented by the ink distribution portion 41 of the fountain press portion 40*a*, which is arranged upstream in the rotational direction of the fountain roller 1. Therefore, the ink on the outer surface of the ink fountain roller 1 is distributed to the right and left of the fountain press portion 40*a*, so adjacent inks do not mix with each other. Since the width T of the fountain press portion 40*a* on the upstream side of the fountain roller 1 is larger than the width t of the fountain press portion 40*a* close to the boundary portion 42, the intermediate ink dam 25 does not slantly attached for the fountain roller 1. For this reason, adjacent inks are prevented from mixing.

Alternatively, since the width t of the fountain press portion 40*a* close to the boundary portion 42 is smaller than the width T of the fountain press portion 40*a* on the upstream side of the fountain roller 1, the boundary portion 42 can stop supplying the ink without making the press force applied to the fountain roller 1 large. That is, the boundary portion 42 having a pair of slant surfaces 42*a* positions downstream of the fountain press portion 40*a* in the rotational direction of the fountain roller 1. For this reason, the boundary portion 42 forms a band portion 45 (width t) with no ink downstream in the rotational direction of the fountain roller 1. This band portion 45 certainly partitions the adjacent inks on the outer surface of the fountain roller 1 so that the inks are prevented from mixing.

In this embodiment, since the press force applied from the press plate 30 to press the fountain roller 1 need not be large, the flexure amount of the fountain roller 1 can decrease to form an ink film 43 with the appropriate film thickness on the outer surface of the fountain roller 1. Also, since the width t of the boundary portion 42 for stopping supplying the ink is small, the boundary portion 42 slightly deforms with respect to the outer surface of the fountain roller 1 and the bottom plate when rotating the fountain roller 1. For this reason, the tight contact of the boundary portion 42 to the ink fountain roller 1 is improved.

Also, since the press force applied from the press plate 30 to the fountain roller 1 can decrease, the overload is not applied from the press plate 30 to the fountain roller 1. For this reason, the overload applied to the rotational driving system of the fountain roller 1 can be prevented. Also, since the press force applied from the press plate 30 to the fountain roller 1 can decrease, the thin ink film is formed between two sides 44 of the fountain press portion 40*a* and the fountain roller 1 to serve as a lubricant. Therefore, the contact resistance between the outer surface of the fountain roller 1 and the fountain press portion 40*a* can decrease, and a driving source for driving the fountain roller 1 can be small.

Also, since the press force applied from the press plate 30 to the fountain roller 1 can decrease, the biasing force of the compression coil spring 18 can decrease. For this reason, when building the parts, the influence such as local contact between parts can be suppressed, and the operation of adjusting the variations of the contact states of the intermediate ink dams 25 with the fountain roller 1 can be facilitated. Also, since the width of the partition of the ink becomes small depending on the width t of the boundary portion 42, the swing amount of the oscillation roller of the ink apparatus decreases, thereby preventing the inks from mixing.

Note that the shape of the distal end is set to be trapezoidal by forming the pair of the slant surfaces 42*a* in order to decrease the width t of the boundary portion 42. However, the present invention is not limited to this. For example, the shape of the distal end of the boundary portion 42 may be a convex. In short, the present invention can be implemented as long as the width t of the boundary portion 42 is smaller than the width T of the fountain press portion 40*a*.

As described above, in the present invention, the intermediate ink dams are not slantly attached for the fountain roller so that the inks are prevented from mixing. Also, since the press force applied to the fountain roller decreases, the ink film with the appropriate film thickness can be formed on the outer surface of the fountain roller, thereby preventing from applying the overload to the rotational system of the fountain roller.

What is claimed is:

1. An ink fountain apparatus for a rotary printing press, which includes an ink fountain comprised of a rotatably supported ink fountain roller, a bottom plate which has a distal end close to an outer surface of said ink fountain roller and extends in an axial direction of said fountain roller, and a pair of ink dams substantially standing upright from said bottom plate and arranged to oppose in the axial direction of said ink fountain roller through a predetermined distance, an intermediate ink dam substantially standing upright from said bottom plate between said pair of ink dams, said intermediate ink dam having a first surface in contact opposite to the outer surface of said fountain roller, a second surface in contact opposite to an upper surface of said bottom plate, and a boundary portion allowing said first surface and said second surface to communicate with each other, and press means for simultaneously pressing said intermediate ink dam toward the outer surface of said fountain roller, and the upper surface of said bottom plate, wherein a width of said first surface close to said boundary portion in the axial direction of said fountain roller is set to be smaller than a width of said first surface on an upstream side of said fountain roller in a rotational direction from said boundary portion in the axial direction of said fountain roller.

2. An apparatus according to claim 1, wherein said boundary portion includes a pair of slant surfaces slanting from two side surfaces of said intermediate ink dam toward said first surface.

3. An apparatus according to claim 2, wherein said boundary portion has a trapezoidal distal end.

4. An apparatus according to claim 2, further comprising a large number of fountain keys which have an upper surface covered with said bottom plate except for the distal end opposing the outer surface of said fountain roller, and juxtapose in the axial direction of said fountain roller, wherein said boundary portion includes a projection projected downstream of said fountain roller in the rotational direction from said second surface, and having the slant surfaces on two side surfaces, and a lower surface of the projection and said second surface contact the upper surface of the distal end of said fountain key and the upper surface of said bottom plate, respectively.

5. An apparatus according to claim 1, wherein said intermediate ink dam includes a press plate which is made of elastic material and which transmits a press force to said fountain roller and said bottom plate while being pressed by said press means, said press plate having said first surface, said second surface and said boundary portion, and when said first surface of the press plate is pressed on the outer surface of said fountain roller, said boundary portion elastically deforms to come into tight contact with the outer surface of said fountain roller.

6. An apparatus according to claim 1, wherein said intermediate ink dam includes an ink distribution portion with a pair of slant surfaces slanting toward the distal end on the upstream side of said fountain roller in the rotational direction from two side surfaces of said intermediate ink dam.

7. An apparatus according to claim 6, wherein said ink distribution portion has a substantially triangular distal end portion on said first surface on the most upstream side of said fountain roller in the rotational direction.

8. An apparatus according to claim 7, wherein the width of the distal end of said first surface of said ink distribution portion is set to be smaller than the width of said first surface close to said boundary portion in the axial direction of said fountain roller.

* * * * *